US006136482A

United States Patent [19]

Imai

[11] Patent Number: 6,136,482

[45] Date of Patent: Oct. 24, 2000

[54] GRADATION IMAGE THERMAL RECORDING METHOD

[75] Inventor: Shinji Imai, Kanagawa-ken, Japan

[73] Assignee: Fuji Photo Film Co., Ltd., Kanagawa-ken, Japan

[21] Appl. No.: 09/394,102

[22] Filed: Sep. 13, 1999

Related U.S. Application Data

[63] Continuation-in-part of application No. 08/695,022, Aug. 9, 1996, abandoned.

[30] Foreign Application Priority Data

Aug. 10, 1995 [JP] Japan ..... 7-204202

[51] Int. Cl.[7] ..... G03C 5/16; G03C 5/56

[52] U.S. Cl. ..... 430/30; 430/332; 430/346; 430/348; 430/494; 430/945; 347/234; 358/480; 358/481

[58] Field of Search ..... 430/30, 332, 346, 430/348, 494, 945; 358/480, 481; 347/234

[56] References Cited

FOREIGN PATENT DOCUMENTS

| | | |
|---|---|---|
| 50-23617 | 3/1975 | Japan . |
| 58-94494 | 6/1983 | Japan . |
| 61-291183 | 12/1986 | Japan . |
| 62-77983 | 4/1987 | Japan . |
| 62-78964 | 4/1987 | Japan . |
| 5-24219 | 2/1993 | Japan . |
| 5-301447 | 11/1993 | Japan . |
| 6-198924 | 7/1994 | Japan . |
| 9-52379A | 2/1997 | Japan . |

*Primary Examiner*—Richard L. Schilling
*Attorney, Agent, or Firm*—Sughrue, Mion, Zinn, Macpeak & Seas, PLLC

[57] ABSTRACT

A gradation image is recorded on a heat-sensitive recording material, which converts light energy applied thereto to heat energy and forms a color in a density according to a quantity of the heat energy by scanning the heat-sensitive recording material in a main scanning direction with a laser beam modulated according to the gradation of an image to be recorded while conveying the heat-sensitive recording material in a sub-scanning direction relative to the laser beam. The heat-sensitive recording material includes a support and a heat-sensitive layer mainly formed of organic material which is formed on the support, and the diameter d of the laser beam as measured in the sub-scanning direction, the recording intervals D in the sub-scanning direction and the sub-scanning frequency f are set to satisfy the formulae:

$$1.66 \leqq d/D \leqq 1.98+10^{4.25} \cdot f^{-1.57} \text{ and}$$

$$200 \text{ Hz} \leqq f \leqq 900 \text{ Hz}.$$

3 Claims, 8 Drawing Sheets

GRADATION IMAGE THERMAL RECORDING METHOD

This is a Continuation-in-Part of application No. 08/695,022 filed Aug. 9, 1996 now abandoned.

BACKGROUND OF THE INVENTION

1. Field of the Invention

This invention relates to a thermal recording method for recording a gradation image on a heat-sensitive recording medium by applying heat energy thereto by a laser beam.

2. Description of the Related Art

There has been put into wide use a thermal recording device which records an image or the like on a heat-sensitive recording medium by applying heat energy to the recording medium. Recently there has been developed a thermal recording device in which a laser is employed as a heat source, thereby making it feasible to effect high speed recording. See, for instance, Japanese Unexamined Patent Publication Nos. 50(1975)-23617, 58(1983)-94494, 62(1987)-77983 and 62(1987)-78964.

We have disclosed a heat-sensitive recording material which is used in such a thermal recording device and on which a high quality gradation image can be recorded. The heat-sensitive recording material comprises a color forming agent, a developing agent and a light absorbing dyestuff (photo-thermo conversion agent) provided on a support film and forms a color in a density according to the heat energy applied. See Japanese Unexamined Patent Publication Nos. 5(1993)-301447 and 5(1993)-24219.

The heat-sensitive recording material has a heat sensitive layer formed by applying, to a support film, coating liquid containing therein emulsion obtained by dissolving microcapsules containing at least a basic dye precursor, a developing agent and a light absorbing dyestuff in organic solvent which is insoluble or slightly soluble in water and then emulsifying the solution.

As the basic dye precursor, is employed a compound which is generally substantially colorless, is colored by donating electrons or accepting protons of acid or the like and has a partial framework of lactone, lactam, sultone, spiro-pyran, ester, amide or the like and in which ring opening or cleavage of the partial framework occurs upon contact with a developing agent. For example, crystal violet lactone, benzoyl leuco methylene blue, malachite green lactone, rhodamine B lactam, 1,3,3-trimethyl-6'-ethyl-8'-butoxyindolinonebenzospiropyran and the like can be used.

As the developing agent for these color forming agents, acidic compounds such as phenol compounds, organic acids, metal salts of organic acids, oxybenzoate esters or the like are employed. As the developing agent, those having a melting point in the range of 50 to 250° C. are preferred, and phenols or organic acids which are slightly soluble in water and have a melting point in the range of 60 to 200 C. are especially preferred. The examples of the developing agent are disclosed, for instance, in Japanese Unexamined Patent Publication No. 61(1986)-291183.

As the light absorbing dyestuff, those having a low light absorption coefficient to visible light and an especially high light absorption coefficient to wavelengths in the infrared region are preferred. For example, cyanine dyestuffs, phthalocyanine dyestuffs, pyrylium and thiopyrylium dyestuffs, azulenium dyestuffs, squarylium dyestuffs, metal complex dyestuffs such as of Ni or Cr, naphthoquinone and anthraquinone dyestuffs, indophenol dyestuffs, indoanyline dyestuffs, triphenylmethane dyestuffs, triarylmethane dyestuffs, aminium and diimmonium dyestuffs and nitroso compounds can be used. Among these compounds, those having a high absorption coefficient to light in near infrared region having wavelengths of 700 to 900 nm are especially preferred in view of the fact that semiconductor lasers oscillating near infrared rays have been put into practice.

In the aforesaid recording device, two-dimensional recording of a gradation image is carried out by causing a laser beam to scan a heat-sensitive recording material in the form of a sheet by use of a polygonal mirror rotating at high speed (main scanning) while conveying the sheet in a sub-scanning direction, and converting light energy of the laser beam to heat energy by light absorbing dyestuff contained in the heat-sensitive recording material.

The heat-sensitive recording material forms a color in a density according to the heat energy applied.

Accordingly, the density of a scanning line can fluctuate under thermal influence of the scanning line recorded just before, and therefore, different from silver salt photography where there is no thermal influence, there is fear that the obtained image deviates from a desired one.

FIG. 8A shows temperature distributions a1 to a7 of main scanning lines in the sub-scanning direction where the sub-scanning frequency is 200 Hz, the diameter of the laser beam as measured in the sub-scanning direction is 120 $\mu$m the recording intervals in the sub-scanning direction are 50 $\mu$m and the sensitivity of the heat-sensitive recording material ($\gamma$ properties) is 5. FIG. 8B shows temperature distributions b1 to b7 of main scanning lines in the sub-scanning direction where the sub-scanning frequency is 900 Hz, the diameter of the laser beam as measured in the sub-scanning direction is 120 $\mu$m, the recording intervals in the sub-scanning direction are 50 $\mu$m, and the sensitivity of the heat-sensitive recording material ($\gamma$ properties) is 5. In the temperature distribution curves a1 to a7 and b1 to b7, the temperature at which the optical density becomes 1.5 is standardized as 1.0, and main scanning by the laser beam is interrupted for an interval corresponding to two main scanning lines between the temperature distribution curves a3 and a4 in FIG. 8A and between the temperature distribution curves b3 and b4 in FIG. 8B. FIGS. 9A and 9B show the density distributions corresponding to the temperature distributions of FIGS. 8A and 8B, respectively.

In the case shown in FIGS. 8A and 9A, the recording time intervals (5 ms in this case) in the sub-scanning direction determined by the sub-scanning frequency is long relative to the time constant of heat dissipation of the heat-sensitive recording material, and accordingly mutual thermal influence between the main scanning lines is very small and the temperature drop factor $\Delta T$ of the temperature distribution a4 to the temperature distribution a5 is only 2% and the density drop factor $\Delta D$ is only 0.1. To the contrast, in the case shown in FIGS. 8B and 9B, the recording time intervals (1 ms in this case) in the sub-scanning direction determined by the sub-scanning frequency is short relative to the time constant of heat dissipation of the heat-sensitive recording material, and accordingly mutual thermal influence between the main scanning lines is very large and the temperature drop factor $\Delta T$ of the temperature distribution a4 to the temperature distribution a5 is as large as 15% and the density drop factor $\Delta D$ is as large as 0.75.

Since one main scanning line is normally formed of thousands of picture elements, the main scanning frequency is much higher than the sub-scanning frequency. Accordingly, the recording time intervals for the picture elements in the main scanning direction is much shorter than the time constant of heat dissipation of the heat-sensitive recording material and thermal influence on the density of a picture element of the picture element located just before thereof in the main scanning direction is negligible.

As a result, fluctuation in density of each picture element due to mutual thermal influence of adjacent picture elements on each other appears mainly on the picture elements adjacent to each other in the sub-scanning direction of the heat-sensitive recording material. That the fluctuation in density depends upon the sub-scanning frequency of the laser beam can be understood from FIGS. 8A, 8B, 9A and 9B. The fluctuation in density also depends upon the diameter of the laser beam as measured in the sub-scanning direction and the recording intervals of the picture elements in the sub-scanning direction. Accordingly, conventionally it takes a long time to set various parameters in order to keep the density drop factor AD within a desired range.

SUMMARY OF THE INVENTION

In view of the foregoing observations and description, the primary object of the present invention is to provide a thermal recording method for thermally recording a gradation image in which an optimal image recording condition can be easily set and a high quality image without anisotropy due to thermal influence can be obtained.

In accordance with the present invention there is provided a thermal recording method in which a gradation image is recorded on a heat-sensitive recording material by scanning the heat-sensitive recording material in a main scanning direction with a laser beam modulated according to a gradation of an image to be recorded while conveying the heat-sensitive recording material in a sub-scanning direction relative to the laser beam, the heat-sensitive recording material which converts light energy applied thereto to heat energy and forms a color in a density according to the heat energy, wherein the heat-sensitive recording material includes a support and a heat-sensitive layer which is substantially formed of organic material and which is formed on the support, and wherein a diameter d of the laser beam as measured in the sub-scanning direction, the recording intervals D in the sub-scanning direction and the sub-scanning frequency f are set to satisfy formulae:

$$1.66 \leqq d/D \leqq 1.98+10^{4.25} \cdot f^{-1.57} \text{ and}$$

$$200 \text{ Hz} \leqq f \leqq 900 \text{ Hz}.$$

When the diameter d of the laser beam as measured in the sub-scanning direction, the recording intervals D in the sub-scanning direction and the sub-scanning frequency f satisfy the above formula, fluctuation in density due to thermal influence between picture elements adjacent to each other in the sub-scanning direction can be suppressed.

DESCRIPTION OF THE PREFERRED EMBODIMENT

Figure 1:
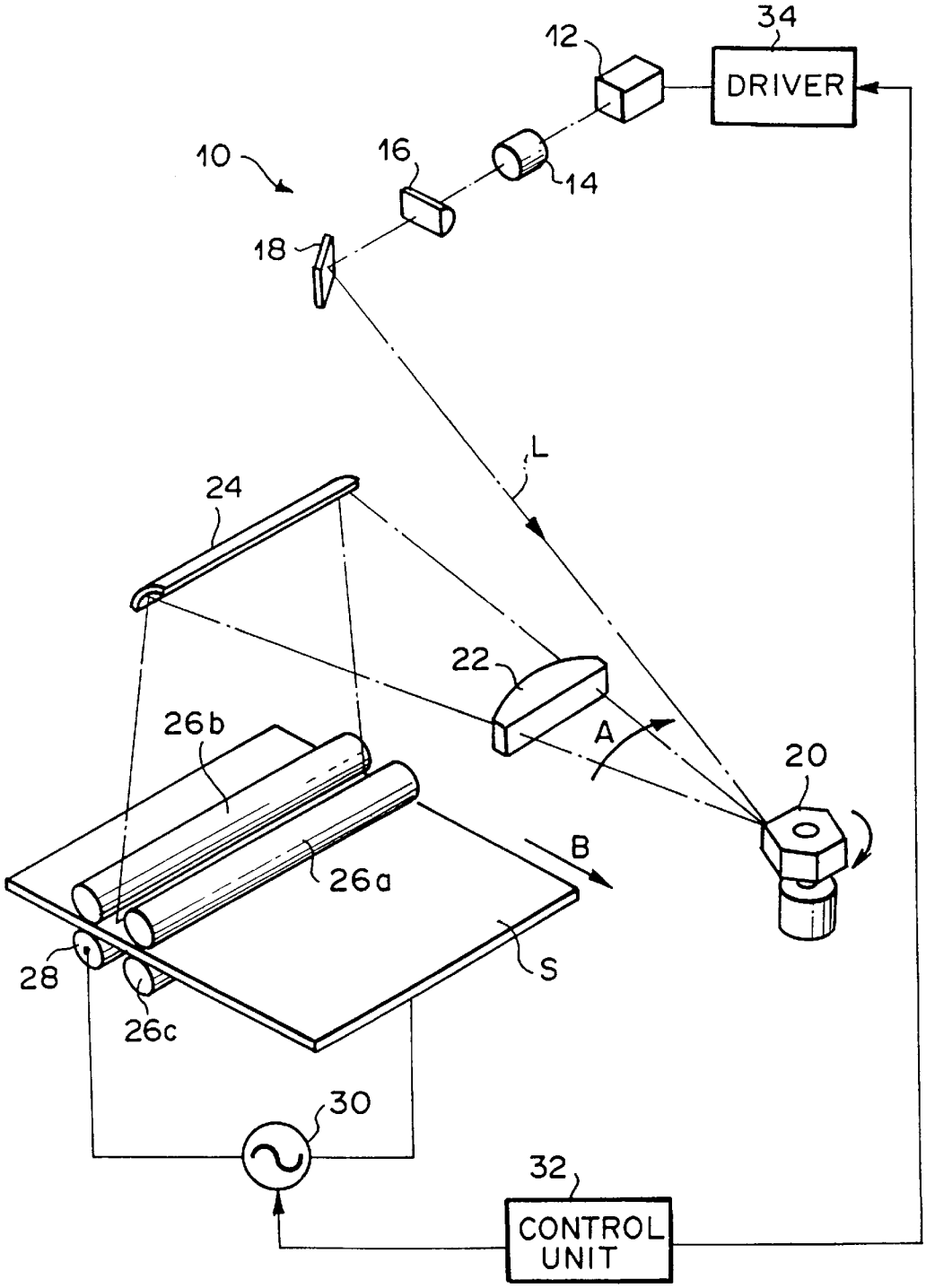
FIG. 1 is a schematic perspective view of a thermal recording device to which the method of the present invention is applied.

In FIG. 1, a thermal recording device 10 is for recording a gradation image on a heat-sensitive recording material S by scanning the heat-sensitive recording material S with a laser beam L in the direction of arrow A (main scanning) while conveying the heat-sensitive recording material S in the direction of arrow B (sub-scanning). The thermal recording device 10 comprises a laser diode 12 which outputs a laser beam L, a collimator lens 14 which collimates the laser beam L, a cylindrical lens 16, a reflecting mirror 18, a polygonal mirror 20 which deflects the laser beam L, an fθ lens 22, a cylindrical mirror 24 which is associated with the cylindrical lens 16 to compensate for surface tilt in deflecting surfaces of the polygonal mirror 20, rolls 26*a* and 26*b* which are in contact with the upper surface of the heat-sensitive recording material S, a roll 26*c* which conveys the heat-sensitive recording material S in the sub-scanning direction associated with the roll 26*a*, a pre-heating roll 28 which is in contact with the lower surface of the heat-sensitive recording material S and applies predetermined heat energy to the heat-sensitive recording material to pre-heat it, and a power source 30 which energizes the pre-heating roll 28. The power sources 30 is controlled by a control unit 32 and the laser diode 12 is controlled by the control unit 32 by way of a driver 34.

Figure 2:
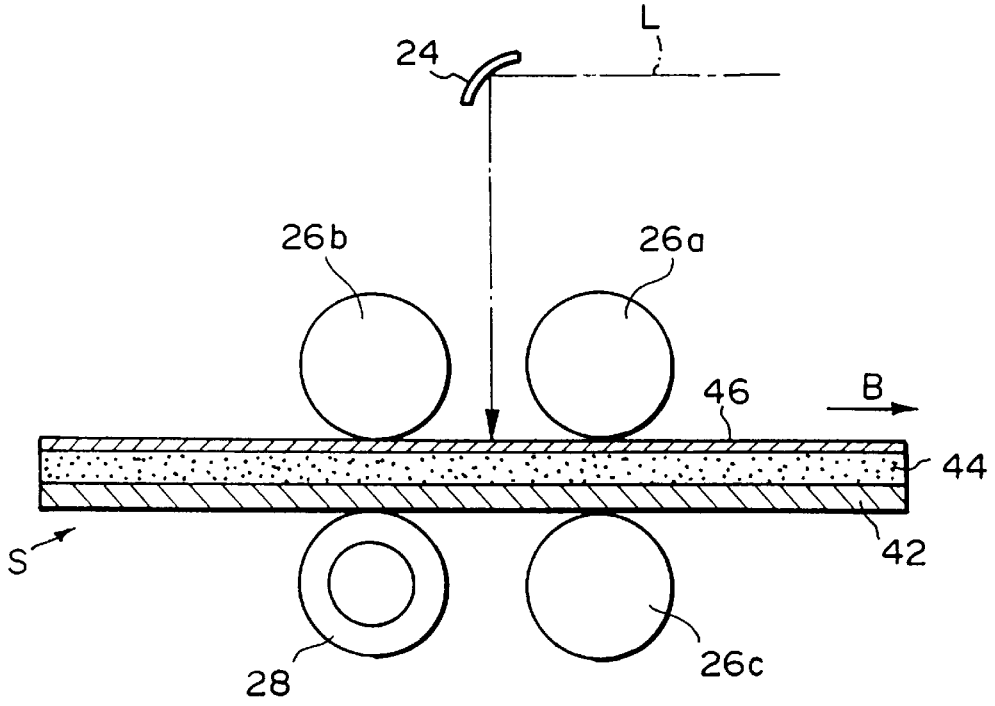
FIG. 2 is a view for illustrating the heat-sensitive recording material and the portion near the recording position in the thermal recording device shown in FIG. 1.
Figure 3:
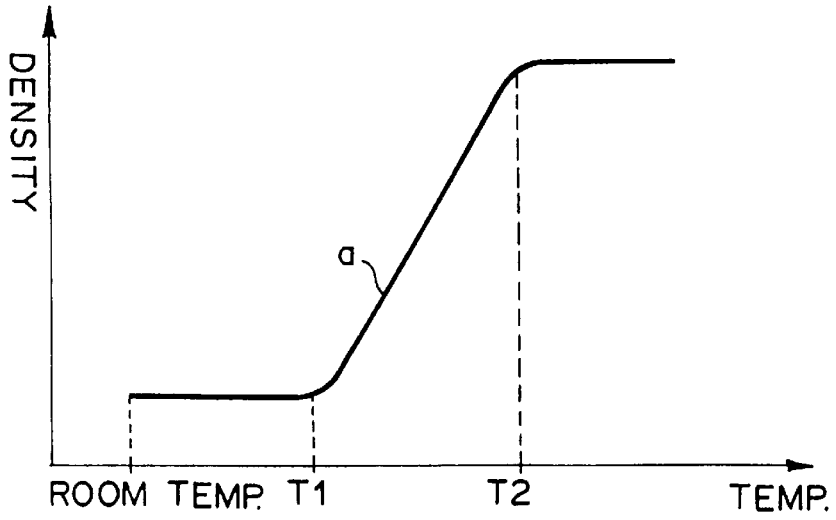
FIG. 3 is a view for illustrating the color forming characteristics of the heat-sensitive recording material.

As shown in FIG. 2, the heat-sensitive recording material S comprises a transparent heat-sensitive layer 44 which contains therein a color forming agent, a developing agent and a photo-thermo conversion agent and is formed on a support film 42 and a protective layer 46 formed on the heat-sensitive layer 44. The color forming agent is enclosed in micro-capsules whose permeability to substances is increased by heat energy from the photo-thermo conversion agent, and a predetermined image density is obtained by reaction of a predetermined amount of the color forming agent with a predetermined amount of the developing agent which is given flowability by the heat energy. As shown in FIG. 3 showing the color forming characteristic curve a of the heat-sensitive recording material S, the heat-sensitive recording material S forms a color in a predetermined density between temperatures T1 and T2 higher than the room temperature. As the materials of the heat-sensitive layer 44, those disclosed, for instance, in Japanese Unexamined Patent Publication Nos. 5(1993)-301447 and 5(1993)-24219 may be employed.

The thermal recording device 10 operates as follows.

That is, the control unit 32 actuates the power source 30 to pre-heat the heat-sensitive recording material S while conveying the heat-sensitive recording material S in the direction of arrow B (sub-scanning) with the recording material S nipped between the rolls 26*b* and the pre-heating roll 28 and between the rolls 26*a* and 26*c*. That is, a predetermined electric current is supplied to the pre-heating roll 28 from the power source 30 and the heat-sensitive recording material S is heated to a temperature T1 just below a color forming temperature.

With the heat-sensitive recording material S pre-heated by the heat roll 28 in this manner, the control unit 32 drives the laser diode 12 by way of the driver 34. The laser diode 12 outputs a laser beam L modulated according to the gradation of an image to be recorded on the heat-sensitive recording material S. The laser beam L is collimated by the collimator lens 14 and impinges upon the polygonal mirror 20 through the cylindrical lens 16 and the reflecting mirror 18. The polygonal mirror 20 is rotating at a high speed and the laser beam L is deflected by the polygonal mirror 20 in the direction of arrow A to impinge upon the heat-sensitive recording material S through the fθ lens 22 and the cylindrical mirror 24, thereby scanning the heat-sensitive recording material S (main scanning) while the recording material S is being conveyed in the sub-scanning direction B.

In the heat-sensitive recording material S, light energy of the laser beam L is converted to heat energy by the photo-thermo conversion agent in the heat-sensitive layer 44 and the permeability to substances of the micro-capsules is increased by the heat energy with the developing agent given flowability by the heat energy, whereby the color forming agent in the capsules reacts with the developing agent and a gradation image having predetermined densities is formed. Further since the heat-sensitive recording material S has been pre-heated to the temperature T1 just below the color forming temperature by the pre-heating roll 28, the laser beam L has only to heat the heat-sensitive recording material S within the temperature range between temperatures T1 and T2, and accordingly a high quality gradation image can be obtained without necessity of high output power of the laser diode 12.

Each of the picture elements of the image recorded on the heat-sensitive recording material S is thermally affected by each other, and accordingly depending upon the image recording condition, the image obtained sometimes exhibits anisotropy in the sub-scanning direction. In accordance with the present invention, the recording condition is set in the following manner.

Figure 4:
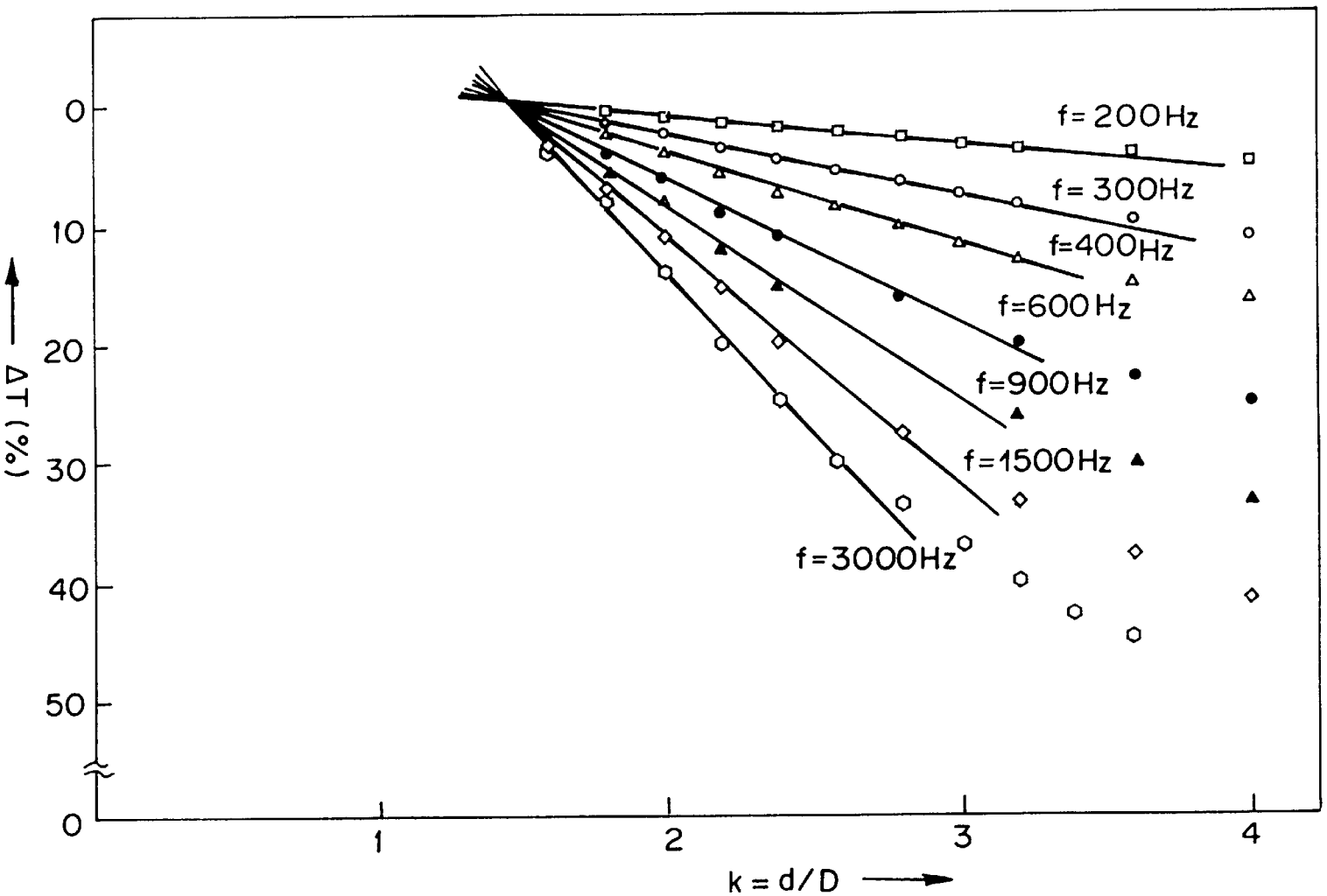
FIG. 4 is a view for illustrating the relation between the temperature drop factor and the diameter of the laser beam in the sub-scanning direction/the recording intervals in the sub-scanning direction.
Figure 5:
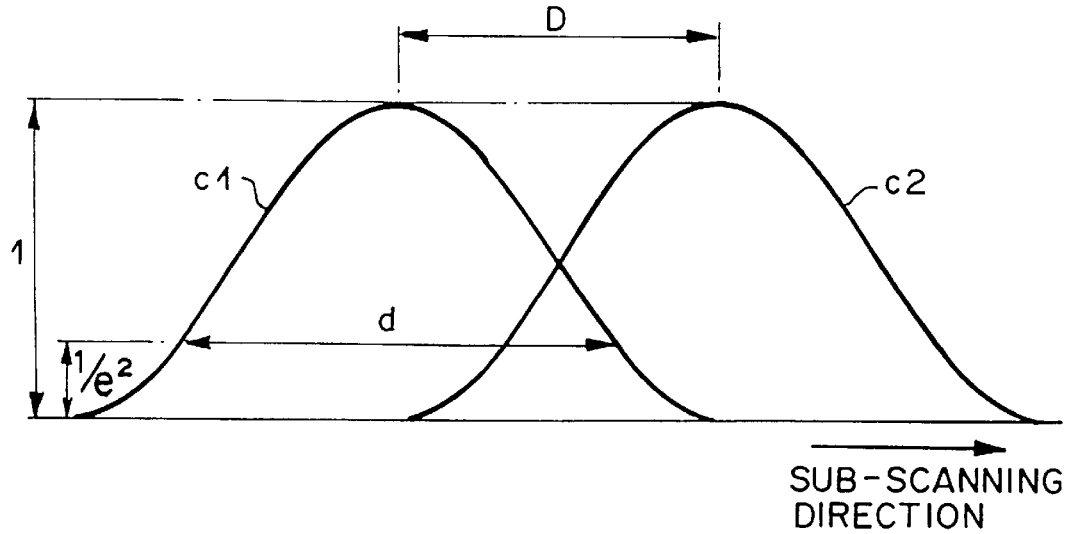
FIG. 5 is a view for illustrating the diameter of the laser beam in the sub-scanning direction and the recording intervals in the sub-scanning direction.
Figure 8A:
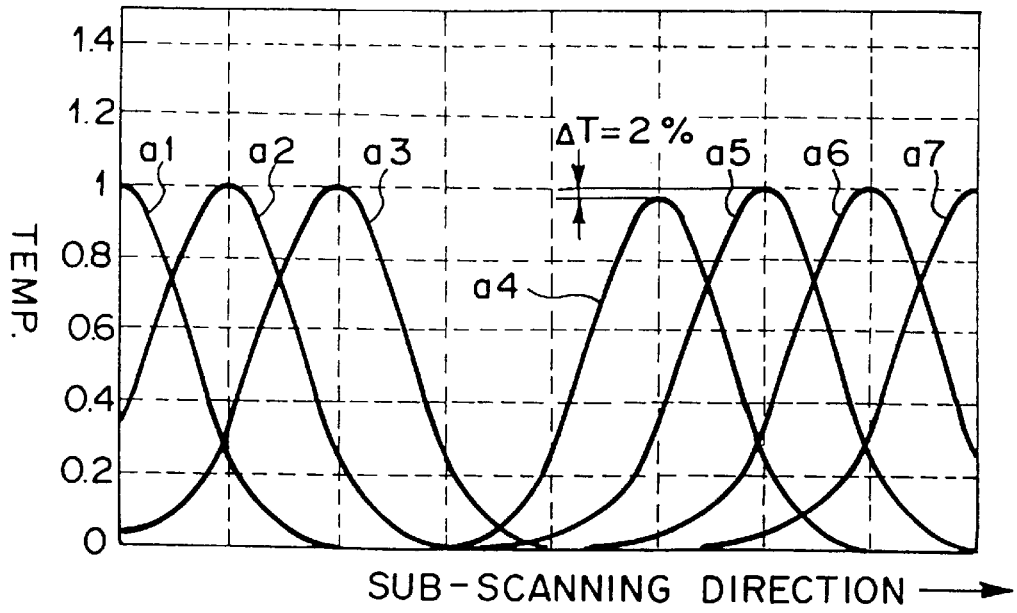
FIG. 8A is a view showing the temperature distribution in the sub-scanning direction when the sub-scanning frequency is relatively low.
Figure 8B:
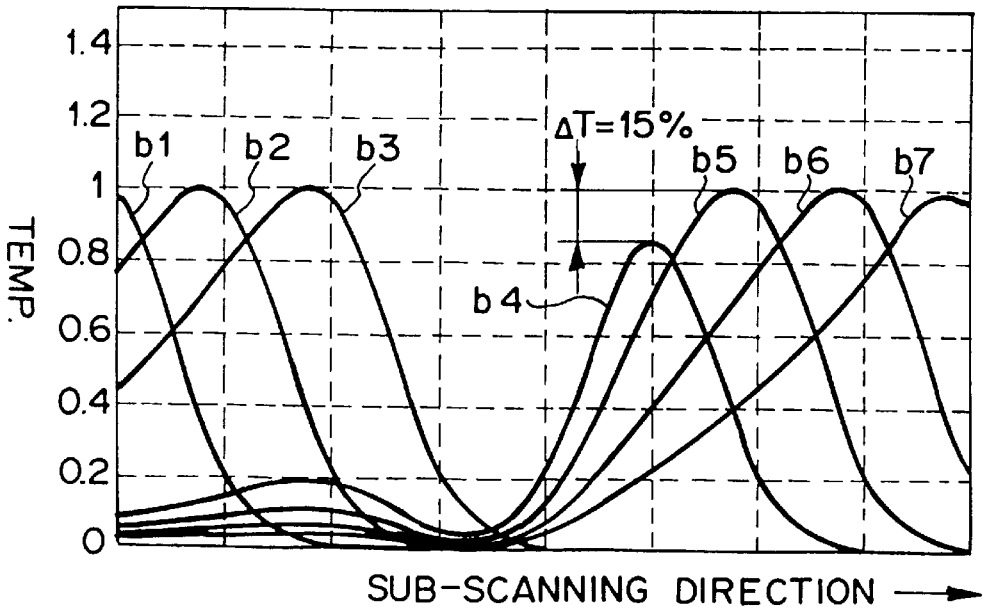
FIG. 8B is a view showing the temperature distribution in the sub-scanning direction when the sub-scanning frequency is relatively high.
Figure 9A:
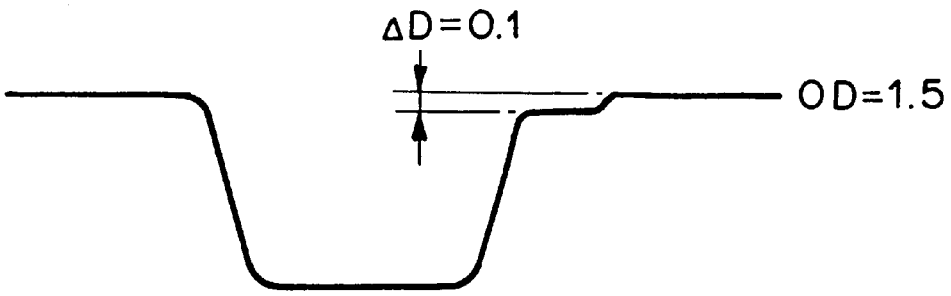
FIG. 9A is a view for illustrating the image density for the case shown in FIG. 8A.
Figure 9B:
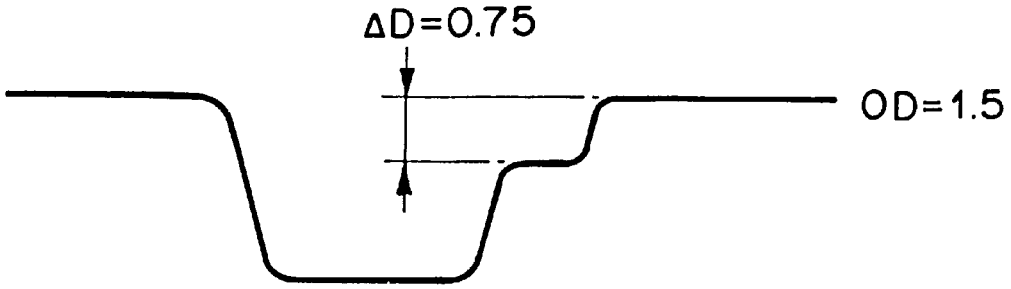
FIG. 9B is a view for illustrating the image density for the case shown in FIG. 8B.
Figure 10:
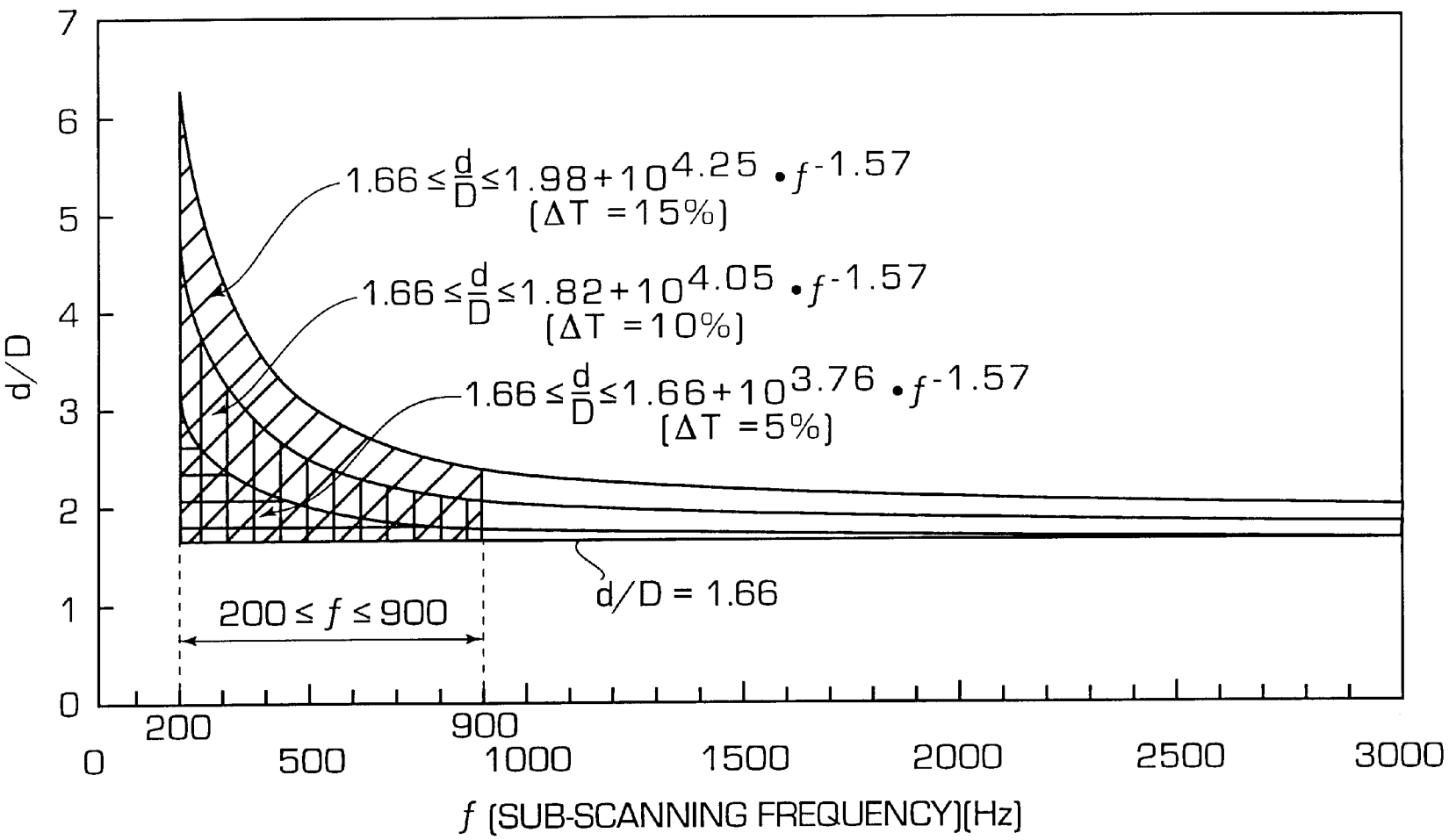
FIG. 10 is a view for illustrating the relation of the parameter of the diameter of the laser beam in the sub-scanning direction and the recording intervals in the sub-scanning direction, to the sub-scanning frequency.

FIG. 4 shows the relation of the temperature drop factor ΔT by which the temperature distributions a4 and b4 (having no picture element recorded just before in the sub-scanning direction) shown in FIGS. 8A and 8B are lower than the temperature distributions a5 and b5 to a parameter k (the diameter d of the laser beam L in the sub-scanning direction/the recording intervals D in the sub-scanning direction) with the sub-scanning frequency f employed as a parameter. As shown in FIG. 5, the peak of the intensity distribution c1 or c2 of the laser beam L is taken as 1 and the diameter d of the laser beam L in the sub-scanning direction is defined as the width of the intensity distribution over which the intensity is not lower than $1/e^2$. The recording interval is defined as the space between the peaks of the intensity distributions c1 and c2. As can be understood from FIG. 4, the relation between the temperature drop factor ΔT and the parameter k (=d/D) is substantially linear at each sub-scanning frequency f, and the temperature drop factor ΔT takes the same value at a particular value of the parameter k (=1.66) irrespective of the sub-scanning frequency f.

Figure 6:
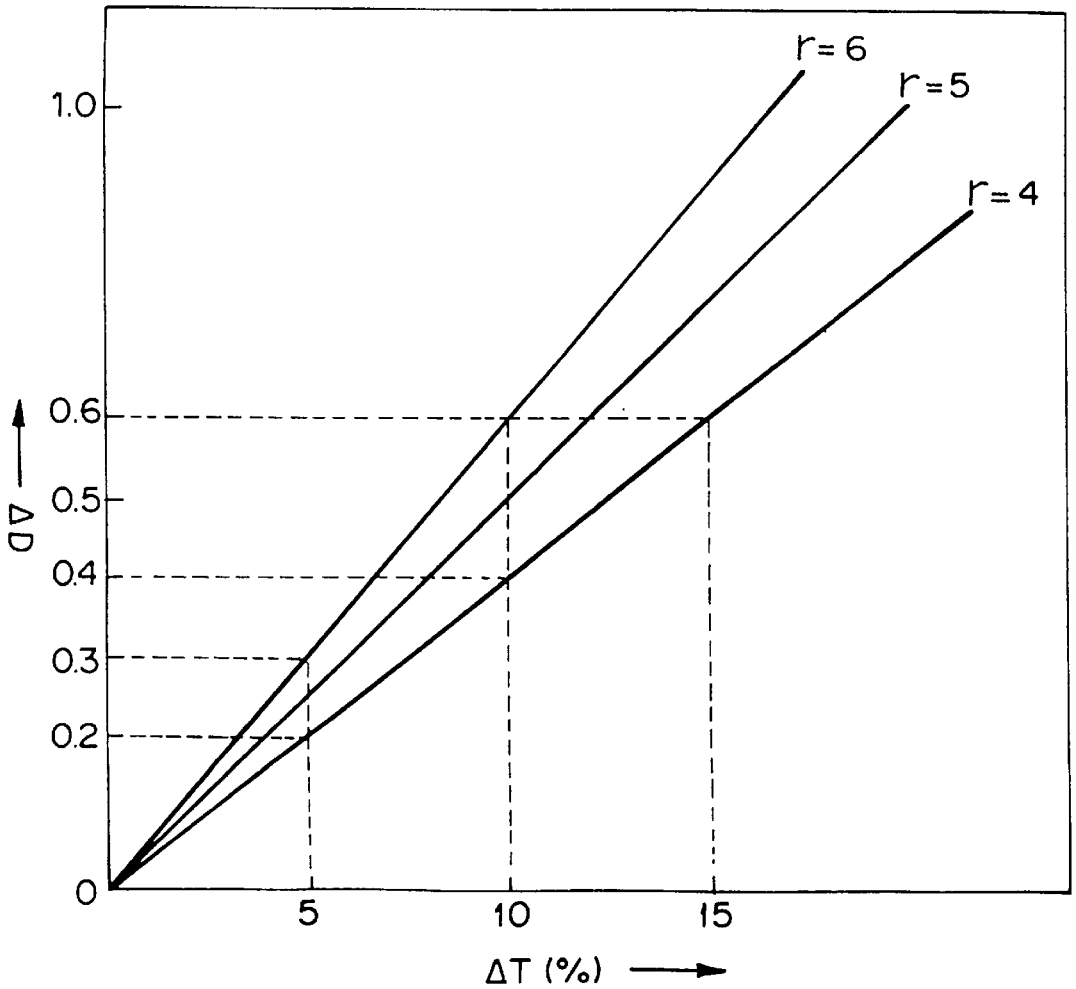
FIG. 6 is a view for illustrating the relation of the sensitivity of the heat-sensitive recording material to the temperature drop factor and the density drop factor.

FIG. 6 shows the relation of the temperature drop factor ΔT to the density drop factor ΔD due to the temperature drop with the sensitivity γ (γ properties) of the heat-sensitive recording material S employed as a parameter. In this case, in order to accept a density drop ΔD of not larger than 0.2 for a heat-sensitive recording material S having a sensitivity γ of 4 and a density drop ΔD of not larger than 0.3 for a heat-sensitive recording material S having a sensitivity γ of 6, the acceptable value of the temperature drop factor ΔT must be not larger than 5%. Similarly in order to accept a density drop ΔD of not larger than 0.4 for a heat-sensitive recording material S having a sensitivity γ of 4 and a density drop ΔD of not larger than 0.6 for a heat-sensitive recording material S having a sensitivity γ of 6, the acceptable value of the temperature drop factor ΔT must be not larger than 10%. Further in order to accept a density drop ΔD of not larger than 0.6 for a heat-sensitive recording material S having a sensitivity γ of 4, the acceptable value of the temperature drop factor ΔT must be not larger than 15%.

Figure 7:
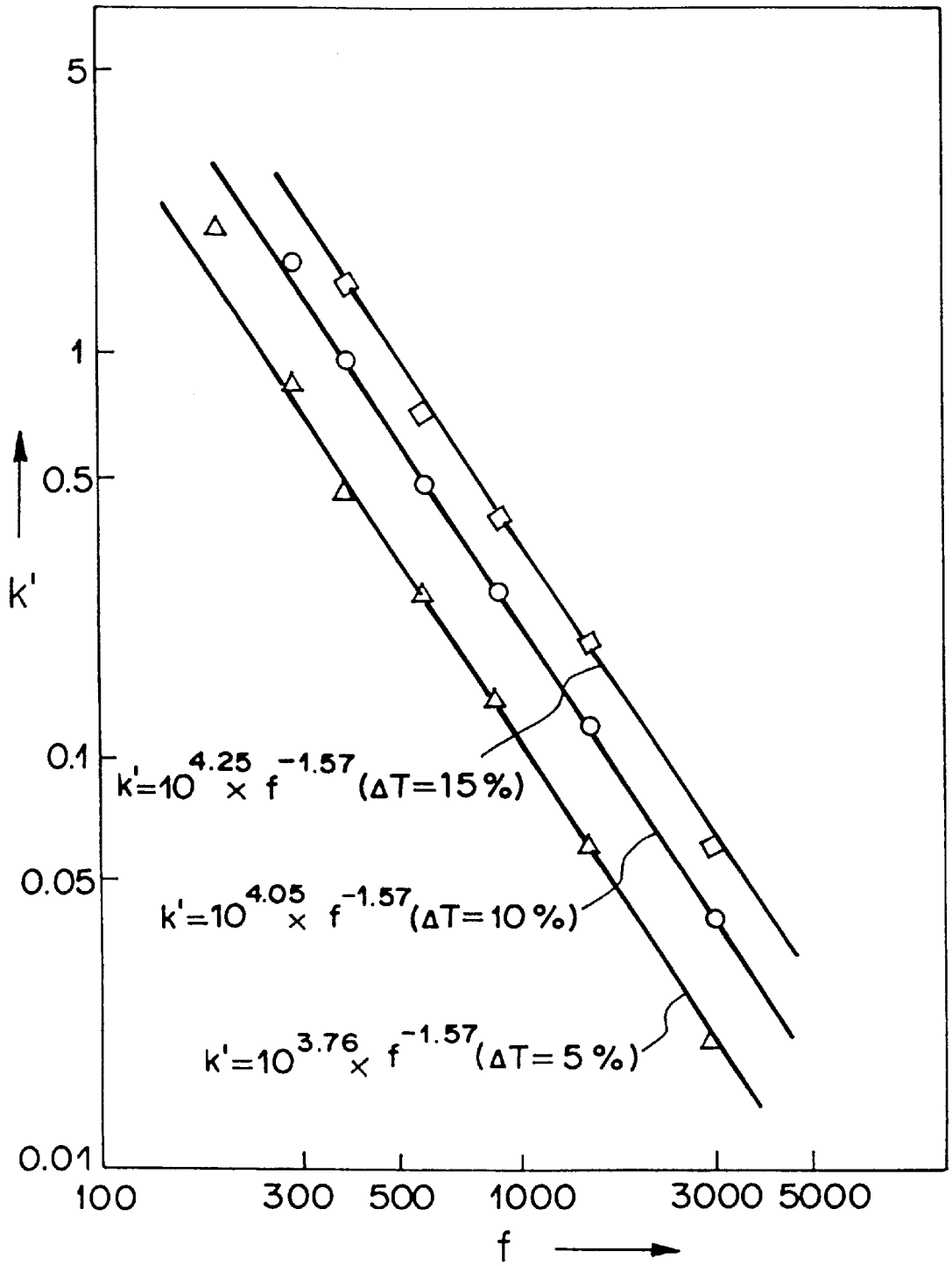
FIG. 7 is a view for illustrating the relation of the sub-scanning frequency to the parameter determined by the diameter of the laser beam in the sub-scanning direction and the recording intervals in the sub-scanning direction.

This inventor has found from a logarithmic graph shown in FIG. 7 that the relation represented by the following formula (1) can be obtained when, in the relation shown in FIG. 4, the relation between parameter k' (k'=k−ko) and the sub-scanning frequency f is obtained with the temperature drop factor ΔT fixed.

$$k'=\alpha\cdot f^{-\beta} \tag{1}$$

wherein α and β are constants determined by the temperature drop factor ΔT. In FIG. 7, the relations between the parameter k' and the sub-scanning frequency f for temperature drop factors ΔT of 5%, 10% and 15%.

Thus, from formula (1) it can be understood that, by setting the diameter d of the laser beam as measured in the sub-scanning direction, the recording intervals D in the sub-scanning direction and the sub-scanning frequency f to satisfy formula $$d/D \leqq \alpha\cdot f^{-\beta}+ko$$

the fluctuation in density in the sub-scanning direction can be made within a predetermined acceptable density range determined by the temperature drop factor ΔT, whereby an image free from thermal influence in the sub-scanning direction can be obtained. For temperature drop factors ΔT of 5%, 10% and 15%, an excellent image free from anisotropy can be obtained when the following formulas are satisfied.

$$d/D \leqq 1.66+10^{3.76}\cdot f^{-1.57}(\Delta T \leqq 5\%)$$

$$d/D \leqq 1.82+10^{4.05}\cdot f^{-1.57}(\Delta T \leqq 10\%)$$

$$d/D \leqq 1.98+10^{4.25}\cdot f^{-1.57}(\Delta T \leqq 15\%)$$

Further, in another embodiment of the present invention, the heat-sensitive recording material S includes a support 42 and a heat-sensitive layer 44 formed on the support 42, the heat-sensitive layer 44 being formed mainly of an organic material. This type of heat-sensitive recording material S, which includes a heat-sensitive layer 44 mainly formed of an organic material, exhibits a time constant of heat dissipation of about 2 msec, almost regardless of what kind of organic material is used. This is because the properties related to thermal diffusion which are possessed by the organic material are not changed to a great degree depending on the different kinds of organic material used. Thus, the characteristics shown in FIGS. 4, 7, 8A, 8B, 9A, and 9B, are well met if a heat-sensitive layer 44 mainly made of an organic material is used.

If a heat-sensitive layer S made of an inorganic material is used, the characteristics of FIGS. 4, 7, 8A, 8B, 9A, and 9B, are not necessarily met. As alluded to earlier on page 5, the time constant of heat dissipation of the heat-sensitive recording material is about 2 msec (i.e., shorter than 5 msec and longer than 1 msec).

Thus, the present invention requires that a smaller value of the parameter k (=d/D) is required, by reducing the value of d or increasing the value of D, but not reducing the value of k to too small a value. As can be shown in FIG. 8, good results without thermal influence can be obtained not only when d/D is set to be below 1.66, but also when d/D is set to be within a given range with the sub-scanning frequency being set between a given range, even if d/D exceeds 1.66. Thus, a specific range of d/D is required to achieve good results without thermal influence (see FIG. 8).

Further, a specific range of the sub-scanning frequency f is required to achieve these good results. When the sub-scanning is performed at a recording time interval close to about 2 msec, which is the time constant of heat dissipation of the claimed heat-sensitive recording material S, the thermal influence is notably changed according to changes in the sub-scanning frequency f. Hence, in the claimed range for the sub-scanning frequency f, wherein 200 Hz (time interval of about 5 msec) and 900 Hz (time interval of about 1 msec) are the lower and the upper limits, the formulae discussed below are very effective.

To exhibit the above features, as stated above, FIG. 8 recasts the information shown in FIG. 7, and shows the relationship between the parameter k (d/D) and the sub-scanning frequency f for the temperature drop factors ΔT of 5%, 10%, and 15%. Thus, for the temperature drop factors ΔT of 5%, 10%, and 15%, between a sub-scanning frequency of 200 z and 900 Hz, an excellent image free from anisotropy can be obtained when the following formulae are satisfied.

$$1.66 \leqq d/D \leqq 1.66+10^{3.76} \cdot f^{-1.57} (\Delta T=5\%)$$

$$1.66 \leqq d/D \leqq 1.82+10^{4.05} \cdot f^{-1.57} (\Delta T=10\%)$$

$$1.66 \leqq d/d \leqq 1.98+10^{4.25} \cdot f^{-1.57} (\Delta T=15\%)$$

As can be understood from the descriptions above, by setting the relation among the diameter of the laser beam as measured in the sub-scanning direction, the recording intervals in the sub-scanning direction and the sub-scanning frequency, the fluctuation in density in the sub-scanning direction due to thermal influence can be suppressed within a desired range. Further the formed image can be isotropic in both the main scanning direction and the sub-scanning direction, and at the same time, an excellent image can be obtained very easily without setting the aforesaid relation on the basis of trial and error.

What is claimed is:

1. A thermal recording method comprising the steps of:

recording a gradation image on a heat-sensitive recording material by scanning the heat-sensitive recording material in a main scanning direction with a laser beam modulated according to a gradation of an image to be recorded while conveying the heat-sensitive recording material in a sub-scanning direction relative to the laser beam, said heat-sensitive recording material which converts light energy applied thereto to heat energy and forms a color in a density according to the heat energy, wherein the heat-sensitive recording material comprises a support and a heat-sensitive layer which is substantially formed of organic material and which is formed on the support, and wherein a diameter d of the laser beam as measured in the sub-scanning direction, the recording intervals D in the sub-scanning direction and the sub-scanning frequency f are set to satisfy formulae:

$$1.66 \leqq d/D \leqq 1.98+10^{4.25} \cdot f^{-1.57} \text{ and}$$

$$200 \text{ Hz} \leqq f \leqq 900 \text{ Hz}.$$

2. The thermal recording method of claim 1, wherein the diameter d of the laser beam as measured in the sub-scanning direction, the recording intervals D in the sub-scanning direction, and the sub-scanning frequency f, are set to satisfy formulae:

$$1.66 \leqq d/D \leqq 1.82+10^{4.05} \cdot f^{-1.57} \text{ and}$$

$$200 \text{ Hz} \leqq f \leqq 900 \text{ Hz}.$$

3. The thermal recording method of claim 1, wherein the diameter d of the laser beam as measured in the sub-scanning direction, the recording intervals D in the sug-scanning direction, and the sub-scanning frequency f, are set to satisfy formulae:

$$1.66 \leqq d/D \leqq 1.66+10^{3.76} \cdot f^{-1.57} \text{ and}$$

$$200 \text{ Hz} \leqq f900 \text{ Hz}.$$

* * * * *